US007932861B2

(12) United States Patent
Hung et al.

(10) Patent No.: US 7,932,861 B2
(45) Date of Patent: Apr. 26, 2011

(54) COMPLEX ANTENNA

(75) Inventors: Chen-Ta Hung, Tu-cheng (TW); Lung-Sheng Tai, Tu-cheng (TW); Wen-Fong Su, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 423 days.

(21) Appl. No.: 12/148,029

(22) Filed: Apr. 16, 2008

(65) Prior Publication Data

US 2008/0252533 A1 Oct. 16, 2008

(30) Foreign Application Priority Data

Apr. 16, 2007 (TW) ..... 96113284 A

(51) Int. Cl.
*H01Q 1/38* (2006.01)
*H01Q 9/04* (2006.01)

(52) U.S. Cl. ..... 343/700 MS; 343/702; 343/829; 343/846

(58) Field of Classification Search ..... 343/700 MS, 343/702, 829, 846
See application file for complete search history.

(56) References Cited

U.S. PATENT DOCUMENTS 6,861,986 B2 3/2005 Fang
7,034,754 B2 * 4/2006 Hung et al. ..... 343/700 MS
7,450,076 B1 * 11/2008 Lin et al. ..... 343/702
7,554,498 B1 * 6/2009 Lee et al. ..... 343/702
7,633,448 B2 * 12/2009 Su et al. ..... 343/702
2005/0190108 A1 9/2005 Lin
2006/0250309 A1 11/2006 Fang
2008/0007461 A1 * 1/2008 Su et al. ..... 343/700 MS
2008/0094293 A1 * 4/2008 Chang et al. ..... 343/702

FOREIGN PATENT DOCUMENTS

TW 200642171 12/2006

* cited by examiner

*Primary Examiner* — Douglas W Owens
*Assistant Examiner* — Chuc D Tran
(74) *Attorney, Agent, or Firm* — Wei Te Chung; Andrew C. Cheng; Ming Chieh Chang

(57) ABSTRACT

A complex antenna comprising a grounding element having a first and second longitudinal sides; a first antenna, operating in a first wireless network, comprising a first radiating body spaced apart from the grounding element and a first connecting element connecting the first radiating body and the grounding element; a second antenna, operating in a second wireless network, comprising a second radiating body spaced apart from the grounding element and a second connecting element connecting the second radiating body and the grounding element; wherein the first antenna extending from the first side of the grounding element and working in a first lower frequency band and a first higher frequency band; the second antenna extends from the second side of the grounding element and working in a second lower frequency band and a second higher frequency band.

19 Claims, 8 Drawing Sheets

COMPLEX ANTENNA

BACKGROUND OF THE INVENTION

1. Field of the Invention

The present invention relates to an antenna, and more particularly to an complex antenna having wider range of frequency band and excellent performance.

2. Description of Prior Art

Wireless communication devices, such as cellular phones, notebook computers, electronic appliances, and the like, are normally equipped with an antenna that serves as a medium for transmission and reception of electromagnetic signals, such as date, audio, image, and so on. However, more and more people dissatisfy their electronic devices only work in WLAN (Wireless Wide Area Network). Making the portable electronic devices working in WWAN (Wireless Wide Area Network) or GPS (Global Positioning System) is a purpose of the many people.

In recent years, WLAN adopts two key technical standards of Bluetooth and Wi-Fi. Bluetooth works in 2.4 GHz, and Wi-Fi works in 2.4 GHz and 5 GHz. However, WWAN adopts three technical standards of GSM (Global System for Mobile Communication), GPS (Global Positioning System) and CDMA (Code Division Multiple Access). Operating frequency bands of the GSM are 900/1800 MHz, and operating frequency band of the GPS is 1.575 GHz. CDMA includes three kinds of technical standards: CDMA2000, WCDMA and TD-SCDMA. Operating frequency bands of the CDMA2000 are 800, 900, 1700, 1800, 1900, and 2100 MHz. Operating frequency bands of the WCDMA are 1800, 1900, and 2100 MHz. Operating frequency bands of the TD-SCDMA are 900, 1800, and 2100 MHz.

Accordingly, an antenna of a notebook must operate in above frequency bands, the portable electronic device is capable of working in WLAN and WWAN. Now, the portable electronic device is usually installed with two antennas for working in the WLAN and WWAN, one antenna working in the WLAN and another antenna working in the WWAN. However, with the development of the miniaturization of the portable electronic device, more and more portable electronic devices are difficult to install two sets antennas in the limited inner space.

Taiwanese patent publication No. 200642171 discloses a multi-band antenna including a WWAN antenna and a WLAN antenna. The multi-band antenna is capable to work in WWAN and WLAN at the same time.

However, the multi-band antenna has narrower range of frequency band, and is not capable to cover all frequency bands of WWAN. In addition, the WLAN antenna and the WWAN antenna extending from common edge of a grounding element influence radiating performance of the antenna.

Hence, in this art, a complex antenna to overcome the above-mentioned disadvantages of the prior art will be described in detail in the following embodiment.

SUMMARY OF THE INVENTION

An object of the present invention is to provide a complex antenna which has more wider frequency band, and the antenna having the excellent performance.

To achieve the aforementioned object, the present invention provides a complex antenna comprising a grounding element having a first and a second longitudinal side, a first antenna, and a second antenna. The first antenna operating in a first wireless network comprises a first radiating body spaced apart from the grounding element and a first connecting element connecting the first radiating body and the grounding element. The second antenna operating in a second wireless network comprises a second radiating body spaced apart from the grounding element and a second connecting element connecting the second radiating body and the grounding element. The first antenna extends from the first side of the grounding element and operates in a first lower frequency band and a first higher frequency band. The second antenna extends from the second side of the grounding element and operates in a second lower frequency band and a second higher frequency band.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
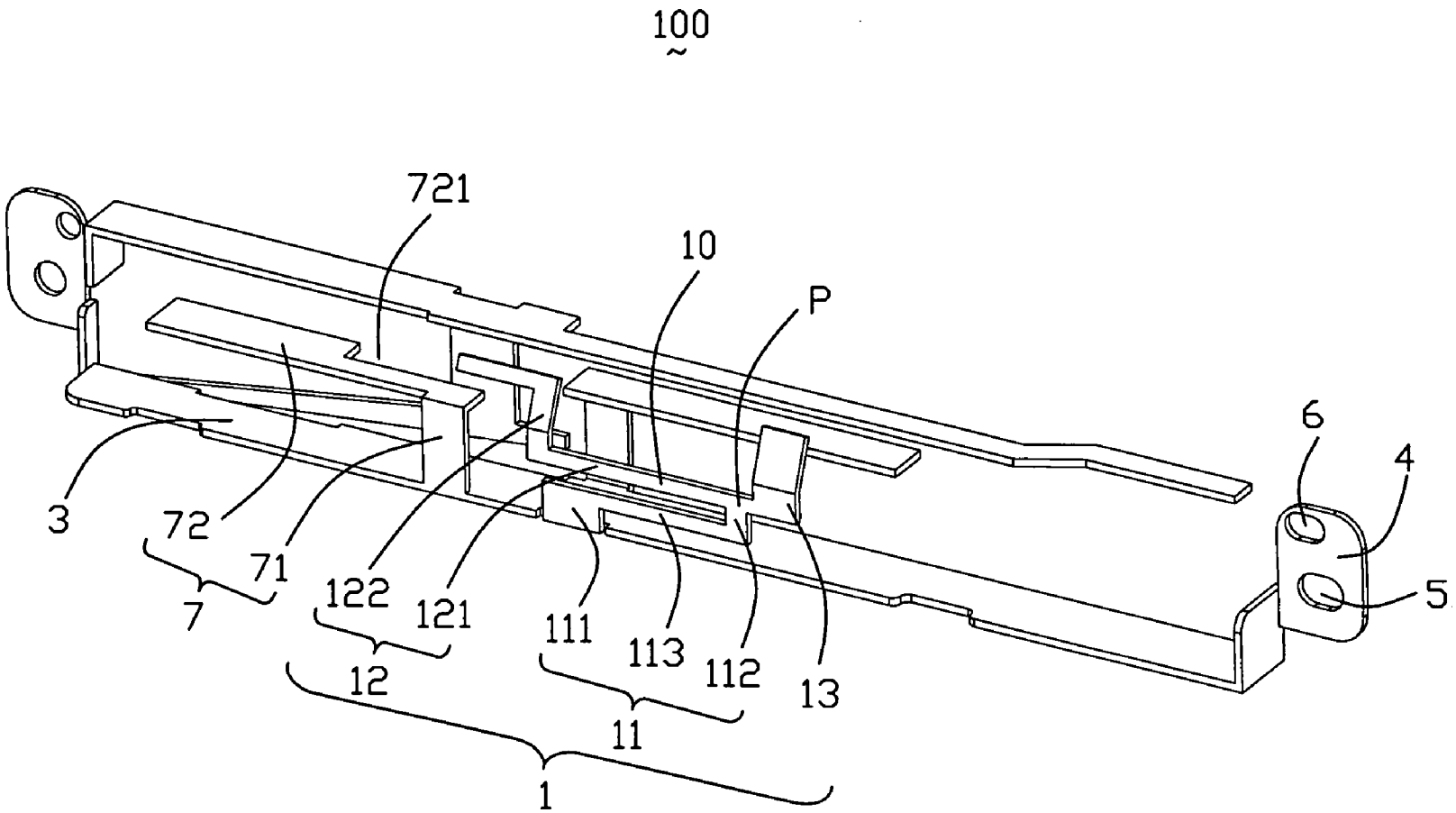
FIG. 1 is a perspective view of a complex antenna in accordance with a first embodiment of the present invention.
Figure 2:
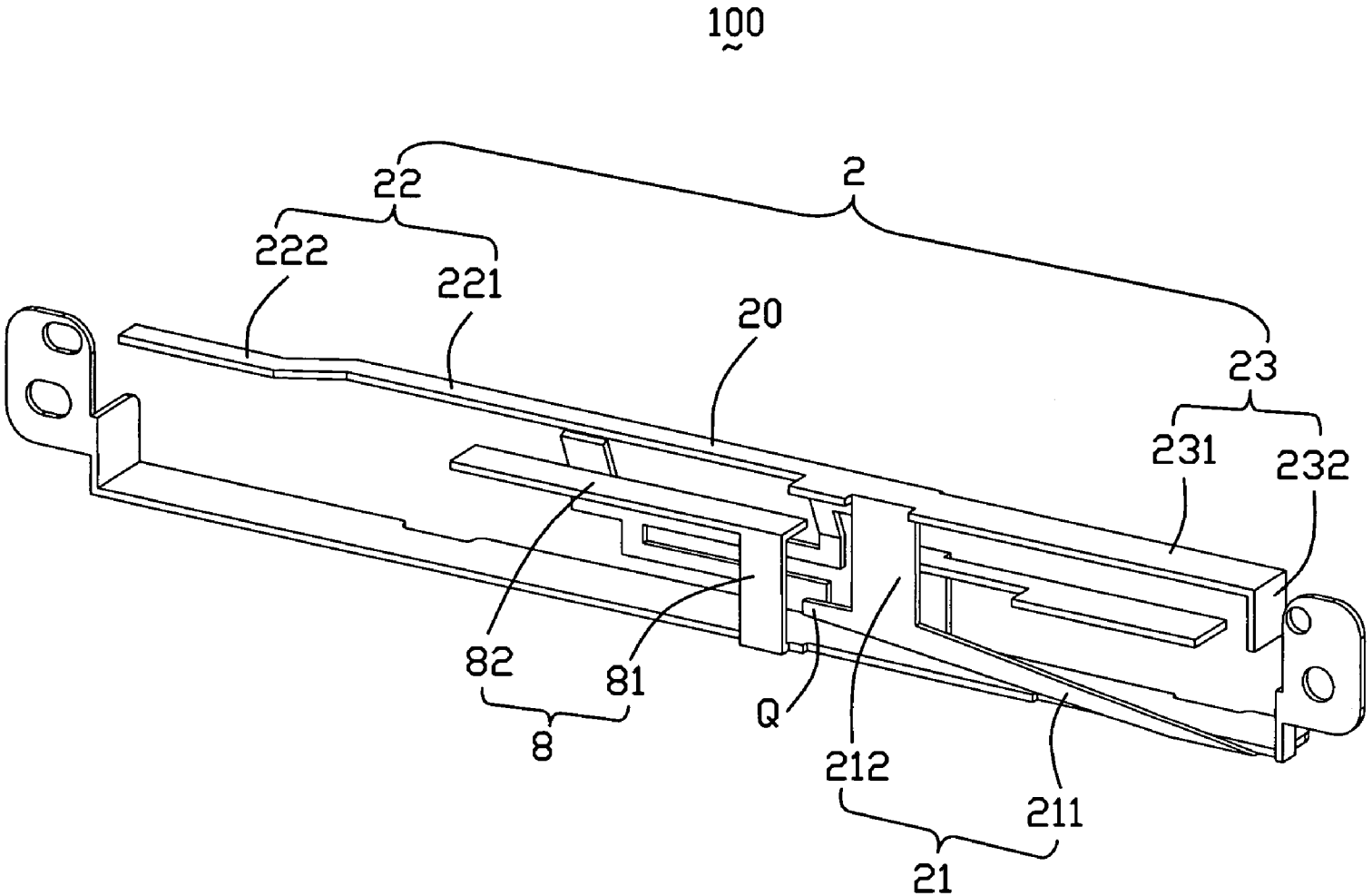
FIG. 2 is a view similar to FIG. 1, but from a different aspect.

Referring to FIGS. 1 and 2, a complex antenna 100 in accordance with a first embodiment of the present invention comprises a grounding element 3 lying in a horizontal plane and having a first and a second longitudinal side, two installing elements 4 locating respectively at two ends of the grounding element 3, a first antenna 1 and a second antenna 2 extending respectively from first and second sides of the grounding element 3. The grounding element 3 has a top surface and a bottom surface. All of the first antenna 1, the second antenna 2, and the installing elements 4 locate upside of the top surface of the grounding element 3.

The first antenna 1 operates in WLAN and extends upwardly from middle portion of the first side of the grounding element 3. The first antenna 1 comprises a first radiating body 10 spaced apart from the grounding element 3, a first connecting element 11 lying in a vertical plane and connecting the grounding element 3. The first connecting element 11 comprises a first branch 111 connecting to the grounding element 3, a second branch 112 connecting to a joint point P of the first radiating body 10, and a third branch 113 connecting the first branch 111 and the second branch 112. The first radiating body 10 comprises a first radiating element 12 working at 2.4 GHz frequency band and a second radiating element 13 working at 5 GHz frequency band. The joint point P of the first connecting element 11 and the first radiating body 10 also is a dividing point of the first radiating element 12 and the second radiating element 13. A first feeding line 91 comprises an inner conductor 911 electrically connecting to the point P, an inner insulating layer 912, an outer conductor 913 electrically connecting to the grounding element 3, and an outer insulating layer 914. The first radiating element 12 comprises a first L-shaped radiating arm 121 extending from the point P and a second L-shaped radiating arm 122 extending upwardly and aslant from an end of the first radiating arm 121. The second radiating element 13 extends upwardly and aslant from the point P.

The second antenna 2 operating in WWAN extends upwardly from the second side of the grounding element 3 adjacent to the installing element 4. The second antenna 2 comprises a second radiating body 20 spaced apart from the grounding element 3 and a second connecting element 21 paralleling to the first connecting element 11 and connecting the second radiating body 20 and the grounding element 3. The second connecting element 21 comprises a first part 211 extending upwardly and aslant from the grounding element 3 and a second part 212 vertically extending and connecting the second radiating body 20 and the first part 211. The second radiating body 20 parallels to the grounding element 3 and comprises a third radiating element 22 operating at 900 MHz frequency band and a fourth radiating element 23 operating at 1800 MHz frequency band. The third radiating element 22 comprises a third radiating arm 221 and a fourth radiating arm 222 extending flexurally from an end of the third radiating arm 221. The fourth radiating element 23 extending from the other end of the third radiating arm 221 opposite to the fourth radiating arm 222 comprising a fifth radiating arm 231 and a sixth radiating arm 232 extending downwardly from an end of the fifth radiating arm 231. A height of the second antenna 2 is equal to the installing element 4. The third radiating element 22 and the fifth radiating arm 231 locate in the same plane and parallel to the grounding element 3. The second connecting element 21 connects to the joint of the third radiating arm 221 and the fifth radiating arm 231. The second connecting element 21 is perpendicular to the third radiating element 22 and the fifth radiating arm 231. A feeding point Q locates at an end of the first part 211 of the second connecting element 21. A second feeding line 92 comprises an inner conductor 921 electrically connecting to the feeding point Q, an inner insulating layer 922, an outer conductor 923 electrically connecting to the grounding element 3, and an outer insulating layer 924.

A first coupling radiating element 7 having L-shape extends upwardly from the first side of the grounding element 3. The first coupling radiating element 7 comprises a first piece 71 extending vertically and upwardly from the side of the grounding element 3 and a second piece 72 extending horizontally from an end of the first piece 71 along a longitudinal direction. A gap 721 is defined in a connecting portion of the first piece 71 and the second piece 72 for reducing the interference between the first coupling radiating element 7 and the first radiating element 12 of the first radiating body 10. A length of the first coupling radiating element 7 is shorter a little than the fourth radiating element 23 of the second radiating body 20. As well known, a length of a radiating element of an antenna is equal to ¼ wavelength of operating frequency. So, the first coupling radiating element 7 operating frequency band is higher a little than the fourth radiating element 23 of the second radiating body 20 and connects to the frequency band of the fourth radiating element 23 of the second radiating body 20 to become a wider frequency band.

A second coupling radiating element 8 having L-shape extends upwardly from the second side of the grounding element 3. The second coupling radiating element 8 comprises a third piece 81 extending vertically and upwardly from the side of the grounding element 3 and a fourth piece 82 extending horizontally from an end of the third piece 81 along a longitudinal direction. A length of the second coupling radiating element 8 is longer a little than the fourth radiating element 23 of the second radiating body 20. So, the second coupling radiating element 8 operating frequency band is lower a little than the fourth radiating element 23 of the second radiating body 20 and connects to the frequency band of the fourth radiating element 23 of the second radiating body 20 to become a more wider frequency band.

The installing elements 4 are positioned respectively at two longitudinal ends of the grounding element 3. Each installing element 4 has a small hole 6 and a big hole 5 for fixing the complex antenna 100 onto the notebook or other electronic device.

Figure 5:
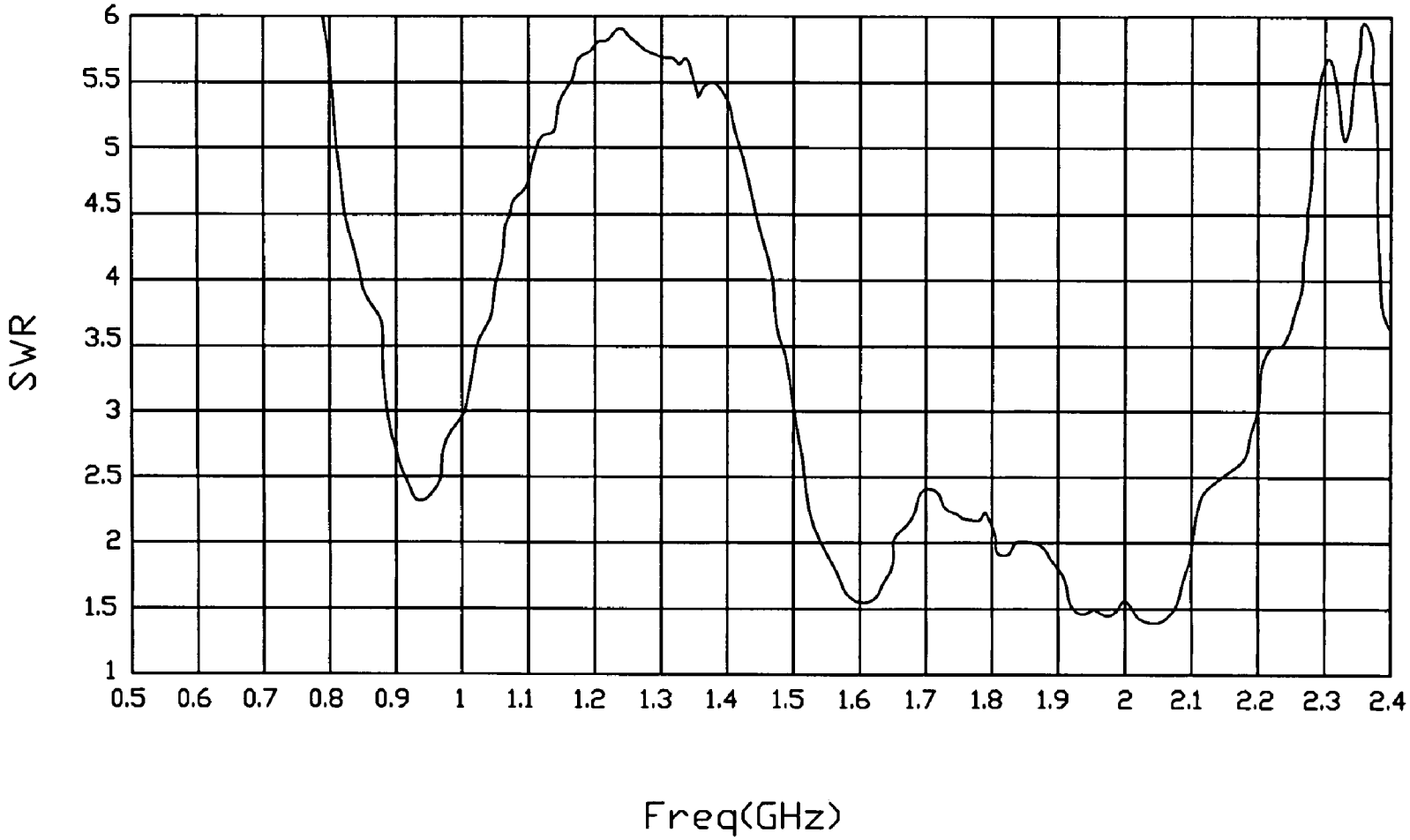
FIG. 5 is a test chart recording for the second antenna of the complex antenna in accordance with a first embodiment of the present invention, showing Voltage Standing Wave Ratio (VSWR) as a function of WLAN frequency.

FIG. 5 is a test chart of Voltage Standing Wave Ratio of the second antenna 2 of the complex antenna 100. Generally speaking, VSWR under 2 dB is considered as having good receiving quality. Referring to FIG. 5, operating frequency band of the second antenna 2 are 880 MHz-1000 MHz and 1.5 GHz-2.2 GHz. Above-mentioned operating frequency bands have covered all of the frequency bands of the WWAN, such as GSM, GPS, CDMA2000, WCDMA, and TD-SCDMA.

Figure 6:
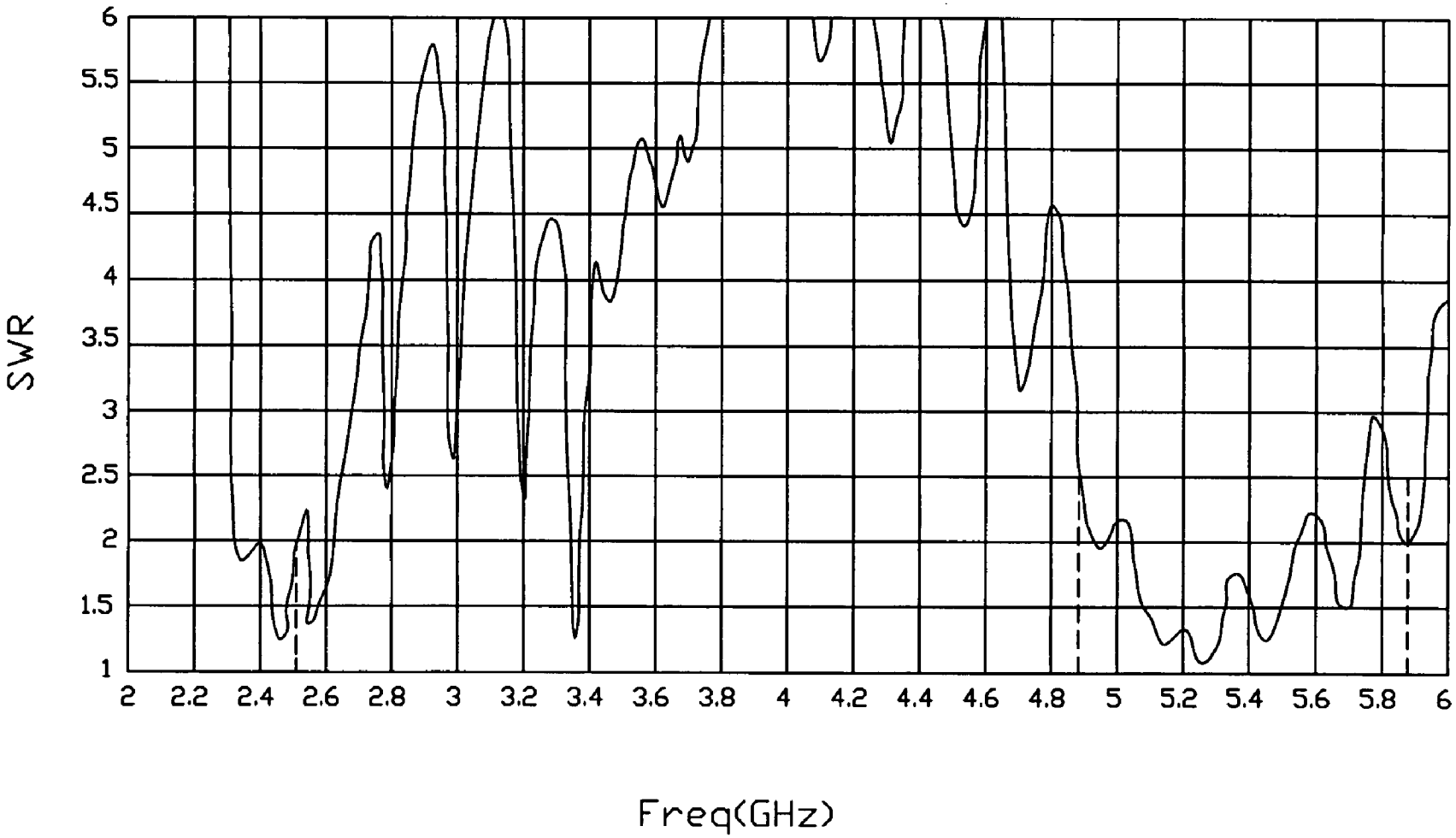
FIG. 6 is a test chart recording for the first antenna of the complex antenna in accordance with a first embodiment of the present invention, showing Voltage Standing Wave Ratio (VSWR) as a function of WWAN frequency.

FIG. 6 is a test chart of Voltage Standing Wave Ratio of the second antenna 1 of the complex antenna 100. Referring to FIG. 6, operating frequency band of the second antenna 1 are 2.4 GHz-2.5 GHz and 4.9 GHz-5.9 GHz. Above-mentioned operating frequency band has covered all of the frequency bands of the WLAN, such as Bluetooth, Wi-Fi, and so on.

Operating frequency band of the complex antenna 100 in accordance with the first embodiment of the present invention has covered all of the frequency bands of the WWAN and WLAN depending on cooperating of the first antenna 1, the second antenna 2, the first coupling radiating element 7, and the second coupling radiating element 8. Further more, the first antenna 1 and the second antenna 2 respectively extend upwardly from opposite sides of the grounding element 3. So, the complex antenna 100 has concentrative structure and can reduce the interference between the first antenna 1 and the second antenna 2.

Figure 3:
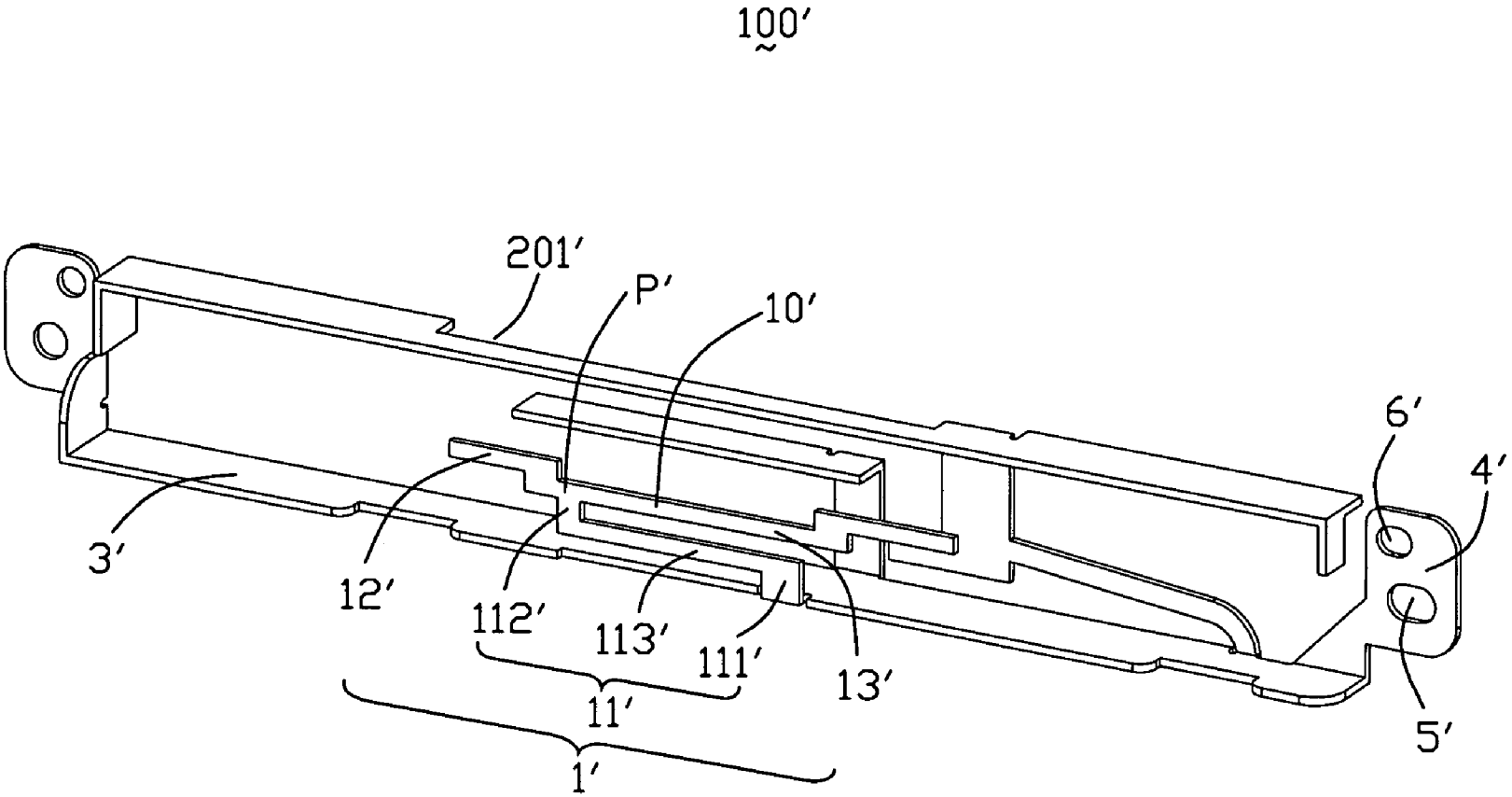
FIG. 3 is a perspective view of a complex antenna in accordance with a second embodiment of the present invention.
Figure 4:
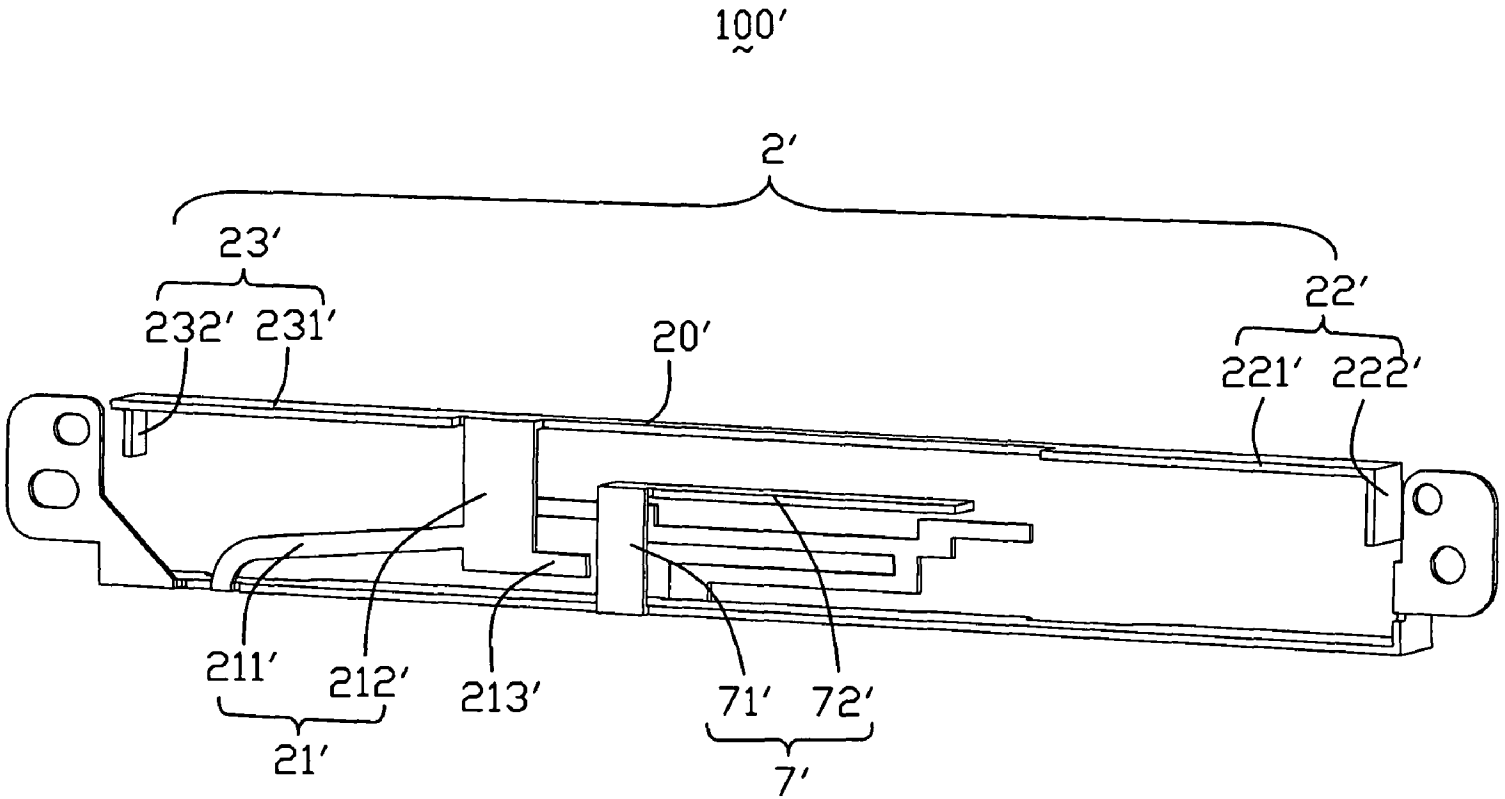
FIG. 4 is a view similar to FIG. 3, but from a different aspect.

Referring to FIG. 3 and FIG. 4, it's a complex antenna 200 in accordance with a second embodiment of the present invention. Basic structure of the complex antenna 200 is approximately same as that of the complex antenna 100. The complex antenna 200 comprises a grounding element 3' having two longitudinal sides, two installing elements 4' locating respectively at two ends of the grounding element 3', a first antenna 1' operating in WLAN and a second antenna 2' operating in WWAN extending respectively from two sides of the grounding element 3'. The grounding element 3' has a top surface and a bottom surface. All of the first antenna 1', the second antenna 2', and the installing elements 4' locate upside of the top surface of the grounding element 3'. Description of the complex antenna 200 is as follows.

The first antenna 1' of the complex antenna 200 extends upwardly from the first side of the grounding element 3' comprising a first radiating body 10' spaced apart from the grounding element 3' and extending along a longitudinal direction and a first connecting element 11' lying in a vertical plane and connecting the first radiating body 10' and the grounding element 3'. The first radiating body 10' comprises a first radiating element 12' having Z-shape and operating at 2.4 GHz frequency band and a second radiating element 13' having Z-shape and operating at 5 GHz frequency band. A joint point P' of the first connecting element 11' and the first radiating body 10' also is a dividing point of the first radiating element 12' and the second radiating element 13'. A third feeding line 91' comprises an inner conductor 911' electrically connecting to the joint P', an inner insulating layer 912', an outer conductor 913' electrically connecting to the grounding element 3', and an outer insulating layer 914'. The first connecting element 11' comprises a first branch 111' extending from a side of the grounding element 3', a second branch 112' connecting to the joint point P', and a third branch 113' connecting the first branch 111' and the second branch 112'. The first radiating element 12', the second radiating element 13', and the first connecting element 11' are in a perpendicular plane.

The second antenna 2' of the Complex antenna 200 extends upwardly from the second side of the grounding element 3'. The second antenna 2' comprises a second radiating body 20' spaced apart from the grounding element 3' and a second connecting element 21' lying in a vertical plane and connecting the second radiating body 20' and the grounding element 3'. The second connecting element 21' comprises a first part 211' extending upwardly and deviously from the side of the grounding element 3' and a second part 212' connecting the first part 211' and the second radiating body 20'. A feeding branch 213' extends along longitudinal direction from a joint of the first part 211' and the second part 212'. A fourth feeding line 92' comprises an inner conductor 921' electrically connecting to the feeding branch 213', an inner insulating layer 922', an outer conductor 923' electrically connecting to the grounding element 3', and an outer insulating layer 924'. Mostly of the second radiating body 20 parallels to the grounding element 3' and comprises a third radiating element 22' operating at 900 MHz frequency band and a fourth radiating element 23' operating at 1800 MHz frequency band. The third radiating element 22' comprises a third radiating arm 221' paralleling to the grounding element 3' and a fourth radiating arm 222' extending vertically and downwardly from an end of the third radiating arm 221'. The fourth radiating element 23' comprises a fifth radiating arm 231' paralleling to the grounding element 3' and a sixth radiating arm 232' extending vertically and downwardly from an end of the fifth radiating arm 231'.

A first coupling radiating element 7' having L-shape extends upwardly from the second side of the grounding element 3. The first coupling radiating element 7' comprises a first piece 71 extending vertically and upwardly from the side of the grounding element 3 and a second piece 72 extending horizontally from an end of the first piece 71 along a longitudinal direction. A gap 201' is defined in the third radiating element 22' of the second radiating body 20' for reducing the interference between the first coupling radiating element 7' and the third radiating element 22' of the second radiating body 20. A length of the first coupling radiating element 7' is shorter a little than the fourth radiating element 23' of the second radiating body 20'. So, the first coupling radiating element 7' operating frequency band is higher a little than the fourth radiating element 23' of the second radiating body 20' and connects to the frequency band of the fourth radiating element 23' of the second radiating body 20' to achieve a wider frequency band.

The installing elements 4' are positioned respectively at two longitudinal ends of the grounding element 3'. Each installing element 4' has a small hole 6' and a big hole 5' for fixing the complex antenna 100 onto the notebook or other electronic device.

Figure 7:
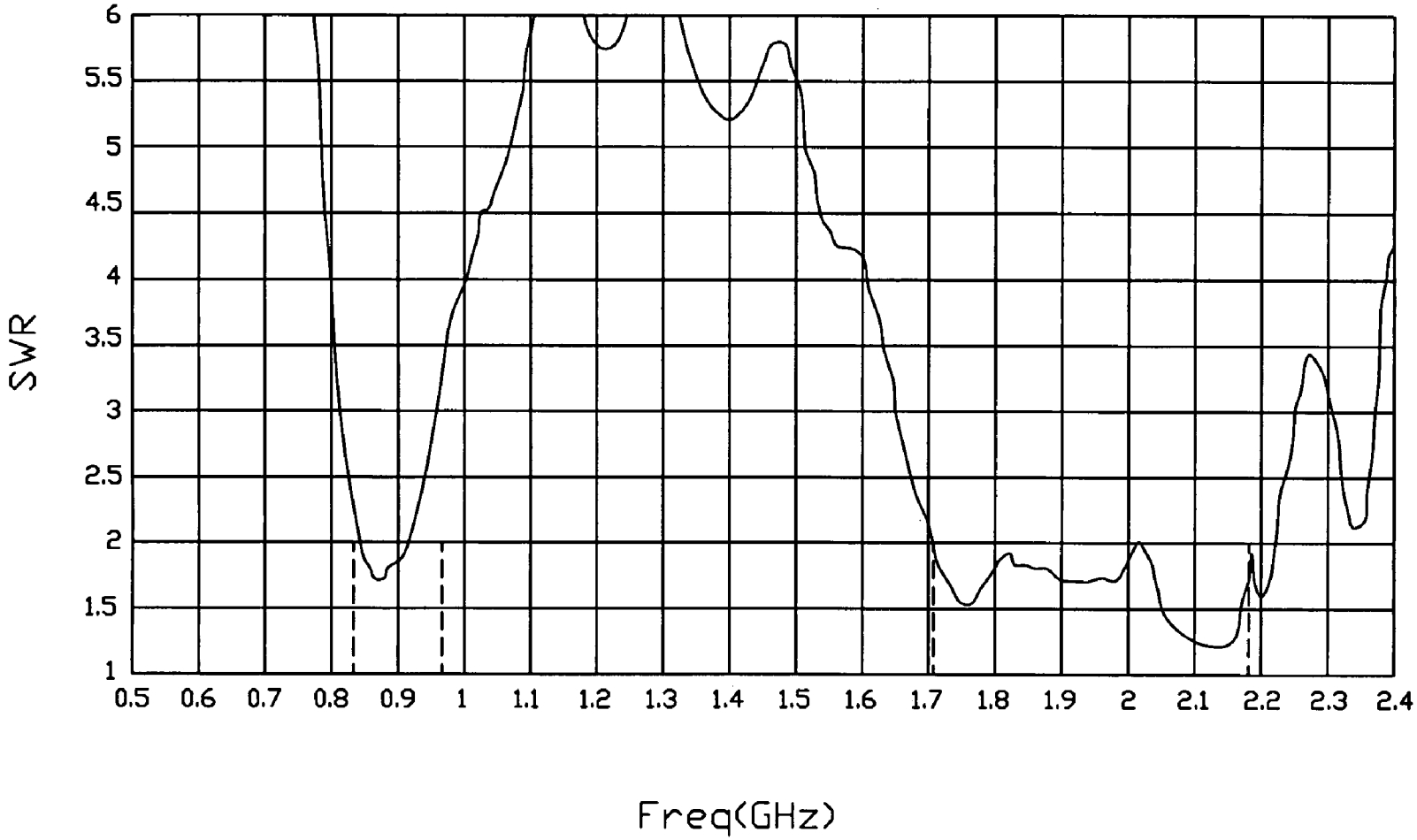
FIG. 7 is a test chart recording for the second antenna of the complex antenna in accordance with a second embodiment of the present invention, showing Voltage Standing Wave Ratio (VSWR) as a function of WWAN frequency.

FIG. 7 is a test chart of Voltage Standing Wave Ratio of the second antenna 2' of the complex antenna 100'. Referring to FIG. 7, operating frequency band of the second antenna 2' are 880 MHz-950 MHz and 1.7 GHz-2.2 GHz. Above-mentioned operating frequency band has covered all of the frequency bands of the WWAN, such as GSM, CDMA2000, WCDMA, and TD-SCDMA.

Figure 8:
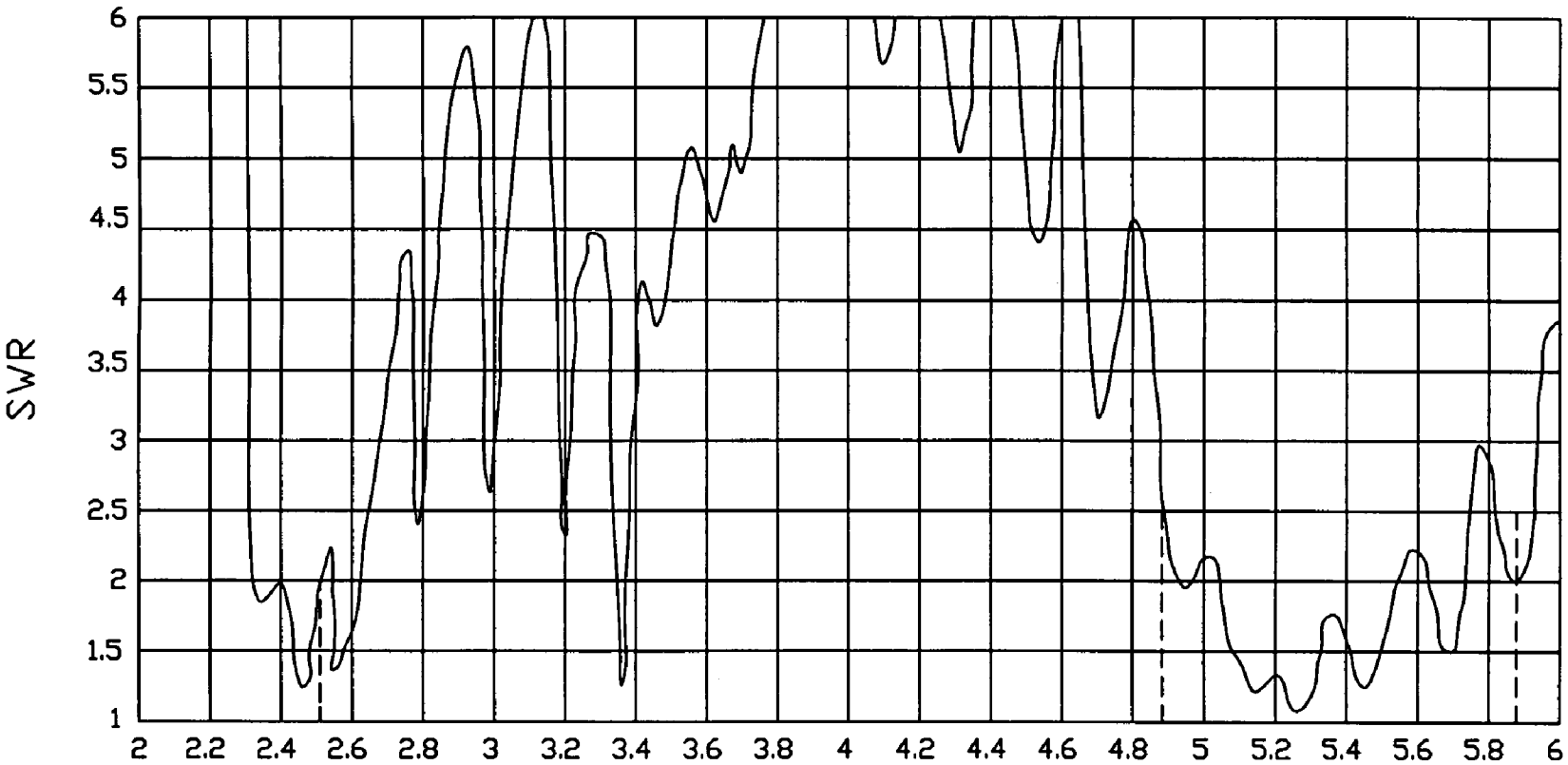
FIG. 8 is a test chart recording for the first antenna of the complex antenna in accordance with a second embodiment of the present invention, showing Voltage Standing Wave Ratio (VSWR) as a function of WLAN frequency.

FIG. 8 is a test chart of Voltage Standing Wave Ratio of the second antenna 1' of the complex antenna 100'. Referring to FIG. 8, operating frequency band of the second antenna 1' are 2.4 GHz-2.5 GHz and 4.9 GHz-5.9 GHz. Above-mentioned operating frequency band has covered all of the frequency bands of the WLAN, such as Bluetooth, Wi-Fi, and so on.

Operating frequency band of the complex antenna 100' in accordance with the first embodiment of the present invention has covered all of the frequency bands of the WWAN and WLAN depending on cooperating of the first antenna 1', the second antenna 2', and the first coupling radiating element 7'. Further more, the first antenna 1' and the second antenna 2' respectively extend upwardly from opposite sides of the grounding element 3'. So, the complex antenna 100' has concentrative structure and can reduce the interference between the first antenna 1' and the second antenna 2'.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A complex antenna comprising:

a grounding element having a first and a second longitudinal side;

a first antenna, operating in a first wireless network, comprising a first radiating body spaced apart from the grounding element and a first connecting element connecting the first radiating body and the grounding element;

a second antenna, operating in a second wireless network, comprising a second radiating body spaced apart from the grounding element and a second connecting element connecting the second radiating body and the grounding element; wherein the first antenna extending from the first side of the grounding element and operating in a first lower frequency band and a first higher frequency band; the second antenna extending from the second side of the grounding element and operating in a second lower frequency band and a second higher frequency band;

wherein said second connecting element comprising a first part extending upwardly and aslant from the second side of the grounding element and a second part extending vertically from the first part.

2. The complex antenna as claimed in claim 1, wherein said complex antenna also comprising a first L-shaped coupling radiating element extending from the first side of the grounding element, the first L-shaped coupling radiating element can widening the second higher frequency band of the second antenna.

3. The complex antenna as claimed in claim 2, wherein said complex antenna also comprising a second L-shaped coupling radiating element extending from the second side of the grounding element, the second L-shaped coupling radiating element can widening the second higher frequency band of the second antenna.

4. The complex antenna as claimed in claim 3, wherein said complex antenna also comprising two installing element defined respectively at two ends of the grounding element.

5. The complex antenna as claimed in claim 4, wherein said all of the first antenna, the second antenna, the first coupling radiating element, the second coupling radiating element, and the installing elements locating upside of the top surface of the grounding element.

6. The complex antenna as claimed in claim 1, wherein said second antenna comprises a feeding line comprising an inner conductor electrically connecting to the end of the first part of the second connecting element.

7. The complex antenna as claimed in claim 1, wherein said first radiating body comprising a first Z-shaped radiating element operating in the first lower frequency band and a second Z-shaped radiating element operating in the first higher frequency band.

8. The complex antenna as claimed in claim 1, wherein said first part of the second connecting element connecting to the grounding element defining circular arc type, a feeding branch extending from a joint of the first part and the second part of the second connecting element.

9. The complex antenna as claimed in claim 1, wherein said second radiating body comprising a third radiating element operating in the second lower frequency band and a fourth radiating element operating in the second higher frequency band.

10. A complex antenna comprising:

a grounding element having a first and a second longitudinal sides;

a first antenna, operating in a first wireless network, comprising a first radiating body spaced apart from the grounding element and a first connecting element connecting the first radiating body and the grounding element; wherein the first antenna extending from the first side of the grounding element and comprising a first Z-shaped radiating element operating in a first lower frequency band and a second Z-shaped radiating element operating in a first higher frequency band.

11. The complex antenna as claimed in claim 10, wherein the complex also comprising a second antenna operating in a second wireless network and comprising a second radiating body spaced apart from the grounding element and a second connecting element connecting the second radiating body and the grounding element.

12. The complex antenna as claimed in claim 11, wherein the second antenna extending from the second side of the grounding element and comprising a third radiating element operating in a second lower frequency band and a fourth radiating element operating in a second higher frequency band.

13. The complex antenna as claimed in claim 12, wherein said complex antenna also comprising two installing element defined respectively at two ends of the grounding element.

14. The complex antenna as claimed in claim 11, wherein said complex antenna also comprising a first L-shaped coupling radiating element extending from the first side of the grounding element, the first L-shaped coupling radiating element can widening the second higher frequency band of the second antenna.

15. The complex antenna as claimed in claim 14, wherein said complex antenna also comprising a second L-shaped coupling radiating element extending from the second side of the grounding element, the second L-shaped coupling radiating element can widening the second higher frequency band of the second antenna.

16. The complex antenna as claimed in claim 15, wherein said all of the first antenna, the second antenna, the first coupling radiating element, the second coupling radiating element, and the installing elements locating upside of the top surface of the grounding element.

17. The complex antenna as claimed in claim 10, wherein said second connecting element comprising a first part extending upwardly and aslant from the second side of the grounding element and a second part extending vertically from the first part.

18. A complex antenna comprising:

a horizontal elongated grounding element having opposite first and second longitudinal side edges;

a first set of antenna having a first radiating body connected to the grounding element via a first connecting element extending upwardly from the first side edge;

a second set of antenna having a second radiating body connected to the grounding element via a second connecting element extending upwardly from the second side edge; wherein the first connection element is located in essentially a first vertical plane and the second connection element is located in essentially a second vertical plane with a constant distance with regard to the first vertical plane; the first radiating body is located in essentially a first horizontal plane and the second radiating body is located in essentially a second horizontal plane with another constant distance with regard to the first horizontal plane.

19. The complex antenna as claimed in claim 18, wherein said first radiating body and said second radiating body are at least partially overlapped with each other in a top view.

* * * * *